US010866018B2

(12) United States Patent
Takeichi et al.

(10) Patent No.: US 10,866,018 B2
(45) Date of Patent: Dec. 15, 2020

(54) AIR CONDITIONER AND CONTROL METHOD THEREOF

(71) Applicant: SAMSUNG ELECTRONICS CO., LTD., Suwon-si (KR)

(72) Inventors: Hisashi Takeichi, Yokohama (JP); Masahiro Aono, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 306 days.

(21) Appl. No.: 15/363,375

(22) Filed: Nov. 29, 2016

(65) Prior Publication Data

US 2017/0241688 A1 Aug. 24, 2017

(30) Foreign Application Priority Data

Feb. 19, 2016 (JP) ..... 2016-029767
Jun. 3, 2016 (KR) ..... 10-2016-0069716

(51) Int. Cl.
*F25B 49/02* (2006.01)
*F25B 13/00* (2006.01)
(Continued)

(52) U.S. Cl.
CPC ..... *F25B 49/02* (2013.01); *F25B 13/00* (2013.01); *F25B 41/04* (2013.01); *F25B 41/067* (2013.01);
(Continued)

(58) Field of Classification Search
CPC ..... F25B 13/00; F25B 41/04; F25B 41/067; F25B 41/043; F25B 43/006;
(Continued)

(56) References Cited

U.S. PATENT DOCUMENTS 3,590,592 A * 7/1971 High ..... F25B 41/06 62/115
4,506,521 A * 3/1985 Asano ..... F25B 41/04 62/238.7
(Continued)

FOREIGN PATENT DOCUMENTS

CN 1786624 6/2006
CN 102109240 6/2011
(Continued)

OTHER PUBLICATIONS

"Circuit." The American Heritage(R) Dictionary of the English Language, edited by Editors of the American Heritage Dictionaries, Houghton Mifflin, 6th edition, 2016. Credo Reference, https://search.credoreference.com/content/entry/hmdictenglang/circuit/0?institutionId=743. Accessed Jul. 6, 2019.*
(Continued)

*Primary Examiner* — Tavia Sullens
(74) *Attorney, Agent, or Firm* — Staas & Halsey LLP

(57) ABSTRACT

An air conditioner is provided. The air conditioner includes a heat pump cycle channel in which a compressor, an outdoor heat exchanger, an expansion valve, and an indoor heat exchanger are connected with one another in sequence. A resistance channel is disposed between an outlet of the compressor and the outdoor heat exchanger to increase pressure of refrigerant flowing from the outlet to the outdoor heat exchanger.

8 Claims, 10 Drawing Sheets

(51) Int. Cl.
*F25B 41/04* (2006.01)
*F25B 41/06* (2006.01)
*F25B 43/00* (2006.01)

(52) U.S. Cl.
CPC ..... *F25B 43/006* (2013.01); *F25B 2400/0411* (2013.01); *F25B 2500/06* (2013.01); *F25B 2600/0271* (2013.01); *F25B 2600/2501* (2013.01); *F25B 2600/2517* (2013.01); *F25B 2700/1931* (2013.01); *F25B 2700/1933* (2013.01); *F25B 2700/2106* (2013.01); *F25B 2700/21152* (2013.01)

(58) Field of Classification Search
CPC ..... F25B 2341/0014; F25B 2341/0016; F25B 2400/0407; F25B 2400/0409; F25B 2500/29; F25B 2500/31; F25B 2500/02; F25B 2500/07; F25B 2500/08; F25B 2500/09; F25B 2500/11; F25B 2400/075; F25B 2400/0751
See application file for complete search history.

(56) References Cited

U.S. PATENT DOCUMENTS

| | | | | |
|---|---|---|---|---|
| 7,257,964 | B2 | 8/2007 | Song et al. | |
| 9,618,237 | B2 | 4/2017 | Kim et al. | |
| 10,082,323 | B2 | 9/2018 | Bae et al. | |
| 2006/0037333 | A1* | 2/2006 | Hwang | F25B 49/022 62/175 |
| 2006/0123817 | A1 | 6/2006 | Song et al. | |
| 2007/0151266 | A1 | 7/2007 | Yakumaru et al. | |
| 2011/0192176 | A1 | 8/2011 | Kim et al. | |
| 2011/0197610 | A1 | 8/2011 | Debesa | |
| 2012/0241139 | A1* | 9/2012 | Katoh | F25B 41/04 165/202 |
| 2012/0266622 | A1 | 10/2012 | Inaba et al. | |
| 2014/0033750 | A1 | 2/2014 | Tanaka et al. | |
| 2014/0305144 | A1 | 10/2014 | Kim et al. | |
| 2015/0020535 | A1* | 1/2015 | Hatomura | F25B 13/00 62/160 |
| 2015/0107290 | A1 | 4/2015 | Hatomura et al. | |
| 2015/0114013 | A1 | 4/2015 | Joo et al. | |
| 2015/0143841 | A1 | 5/2015 | Kawano et al. | |
| 2016/0238290 | A1 | 8/2016 | Bae et al. | |

FOREIGN PATENT DOCUMENTS

| | | | | |
|---|---|---|---|---|
| CN | 102679609 | | 9/2012 | |
| CN | 104110919 | | 10/2014 | |
| CN | 105579791 | A | 5/2016 | |
| CN | 105579791 | B | 4/2018 | |
| EP | 2863147 | A1 | 4/2015 | |
| JP | 61-93351 | | 5/1986 | |
| JP | 62-217058 | | 9/1987 | |
| JP | 5516712 | B2 | 6/2014 | |
| JP | 2015-124912 | A | 7/2015 | |
| JP | 2015-152205 | A | 8/2015 | |
| KR | 10-2011-0010371 | | 2/2001 | |
| KR | 10-0312777 | B1 | 10/2001 | |
| KR | 10-2012-0085071 | A | 7/2012 | |
| KR | 10-1372146 | B1 | 3/2014 | |
| WO | WO-2015046834 | A1 * | 4/2015 | F25B 41/04 |
| WO | WO 2015/107876 | A1 | 7/2015 | |

OTHER PUBLICATIONS

JP 62217058: English Machine Translation. Accessed Jun. 2019.*
Written Opinion; Form PCT/ISA/237; dated Mar. 20, 2017 in corresponding PCT Application No. PCT/KR2016/014355 (9 pages).
International Search Report; Form PCT/ISA/210; dated Mar. 20, 2017 in corresponding PCT Application No. PCT/KR2016/014355 (3 pages).
European Office Action dated Dec. 10, 2018 in European Patent Application No. 16890766.5.
Chinese Office Action dated Jan. 17, 2020 in Chinese Patent Application No. 201680079580.5.
Chinese Office Action dated Sep. 11, 2020, in corresponding Chinese Patent Application No. 201680079580.5.

* cited by examiner

AIR CONDITIONER AND CONTROL METHOD THEREOF

CROSS-REFERENCE TO RELATED APPLICATIONS

This application claims priority from Korean Patent Application No. 10-2016-0069716, filed on Jun. 3, 2016, in the Korean Intellectual Property Office, and Japanese Patent Application No. 2016-029767, filed on Feb. 19, 2016, in the Japanese Patent Office, the disclosure of which is incorporated herein by reference in its entirety.

BACKGROUND OF THE INVENTION

Field of the Invention

Apparatuses and methods consistent with exemplary embodiments relate to an air conditioner.

Description of the Related Art

In recent years, an air conditioner installed in a server room or the like may perform a cooling operation even at low outdoor temperature in the winter, for example, at low outdoor temperature such as 25 degrees below zero or lower.

When the cooling operation is performed at the low outdoor temperature, a heat exchange ability of an outdoor heat exchanger surpasses a heat exchange ability of an indoor heat exchanger, and thus there is no difference between condensation pressure and evaporation pressure. Therefore, there may be a breakdown of a compressor, and in this case, there is a problem that reliability of the compressor cannot be guaranteed.

SUMMARY OF THE INVENTION

One or more exemplary embodiments may overcome the above disadvantages and other disadvantages not described above. However, it is understood that one or more exemplary embodiment are not required to overcome the disadvantages described above, and may not overcome any of the problems described above.

One or more exemplary embodiments provide an air conditioner which can ensure differential pressure of a compressor even when a cooling operation is performed at low outdoor temperature, and a control method thereof.

According to an aspect of an exemplary embodiment, there is provided an air conditioner including: a heat pump cycle in which a compressor, an outdoor heat exchanger, an expansion valve, and an indoor heat exchanger are connected with one another in sequence; and a resistance channel which is disposed between an outlet of the compressor and the outdoor heat exchanger to increase pressure of refrigerant flowing from the outlet to the outdoor heat exchanger.

The resistance channel may include a small bore tube or a capillary tube which has a diameter smaller than a diameter of the outlet.

The air conditioner may further include: a bypass channel which is connected with the resistance channel in parallel; and a bypass valve which opens and closes the bypass channel.

A dimeter of the bypass channel may be larger than a diameter of the resistance channel, and, in response to the bypass valve being opened, a flux of refrigerant passing through the bypass channel may be larger than a flux of refrigerant passing through the resistance channel.

The air conditioner may further include: a return channel which diverges between the outlet and the resistance channel and is connected with an inlet of the compressor; and a return valve which opens and closes the return channel.

A diameter of the return channel may be larger than a diameter of the resistance channel, and, in response to the return valve being opened, some of the refrigerant discharged from the outlet may be returned to the compressor through the return channel.

The air conditioner may further include: an injection channel which diverges between the expansion valve and the indoor heat exchanger and is connected with the inlet; and an injection valve which opens and closes the injection channel, and, in response to the injection valve being opened, some of the refrigerator flowing between the expansion valve and the indoor heat exchanger may flow into the inlet.

The injection channel may have one end diverging between the expansion valve and the indoor heat exchanger, and the other end, which is opposite to the one end, diverging from the return channel.

The air conditioner may further include: an injection channel which diverges between the expansion valve and the indoor heat exchanger and is connected with an inlet of the compressor; and a return channel which has one end diverging between the outlet and the resistance channel, and the other end, which is opposite to the one end, diverging from the injection channel.

The refrigerant may be R32 refrigerant or mixed refrigerant including R32 refrigerant.

According to an aspect of another exemplary embodiment, there is provided a control method of an air conditioner, including: measuring discharge temperature of refrigerant discharged from an outlet of a compressor; comparing the discharge temperature and first reference temperature and second reference temperature which is lower than the first reference temperature; controlling a bypass channel which is connected in parallel with a resistance channel for increasing pressure of refrigerant discharged from the outlet by connecting the outlet and an outdoor heat exchanger, and which has a diameter larger than that of the resistance channel; controlling a return channel which diverges between the outlet and the resistance channel and is connected with an inlet of the compressor, and has a diameter larger than that of the resistance channel; and controlling an injection channel which diverges between an expansion valve of the compressor and an indoor heat exchanger connected with the expansion valve, and is connected with the inlet.

In response to the discharge temperature being greater than or equal to the second reference temperature and being less than the first reference temperature, the return channel may be closed and the injection channel may be opened by a predetermined opening degree.

In response to the discharge temperature being greater than or equal to the first reference temperature, the bypass channel may be opened, the return channel may be closed, and the injection channel may be opened by a predetermined opening degree.

According to an aspect of another exemplary embodiment, there is provided a control method of an air conditioner, including: measuring outdoor temperature of a place where a compressor is disposed; comparing the outdoor temperature and predetermined low control temperature; measuring discharge pressure of refrigerant discharged from an outlet of the compressor and inflow pressure of refrigerant flowing into an inlet of the compressor; comparing a compression ratio which is calculated by dividing the discharge pressure by the inflow pressure, and a predetermined reference value; comparing the discharge pressure and first reference pressure and second reference pressure which is larger than the first reference pressure; controlling a bypass channel which is connected in parallel with a resistance channel for increasing pressure of refrigerant discharged from the outlet by connecting the outlet and an outdoor heat exchanger, and has a diameter larger than that of the resistance channel; and controlling a return channel which diverges between the outlet and the resistance channel and is connected with an inlet of the compressor, and has a diameter larger than that of the resistance channel.

In response to the outdoor temperature being greater than or equal to the low control temperature or the compression ratio being greater than or equal to the reference value, the bypass channel may be opened and the return channel may be closed.

In response to the outdoor temperature being less than the low control temperature and the compression ratio being less than the reference value, and in response to the discharge pressure being less than first reference pressure, the bypass channel may be closed and the return channel may be opened.

In response to the outdoor temperature being less than the low control temperature and the compression ratio being less than the reference value, and in response to the discharge pressure being greater than or equal to the first reference pressure and being less than the second reference pressure, the bypass channel may be opened and the return channel may be opened.

In response to the outdoor temperature being less than the low control temperature and the compression ratio being less than the reference value, and in response to the discharge pressure being greater than or equal to the second reference pressure, the bypass channel may be opened and the return channel may be closed.

The control method may further include re-measuring the discharge pressure and the inflow pressure, and, in response to a difference between the re-measured discharge pressure and the re-measured inflow pressure being greater than or equal to a predetermined value, the bypass channel may be opened and the return channel may be closed.

The control method may further include re-measuring the discharge pressure and the inflow pressure, and, in response to a compression ratio which is calculated by dividing the re-measured discharge pressure by the re-measured inflow pressure being greater than or equal to a predetermined value, the bypass channel may be opened and the return channel may be closed.

Additional and/or other aspects and advantages of the invention will be set forth in part in the description which follows and, in part, will be obvious from the description, or may be learned by practice of the invention.

BRIEF DESCRIPTION OF THE DRAWING FIGURES

The above and/or other aspects of the present disclosure will be more apparent by describing certain exemplary embodiments of the present disclosure with reference to the accompanying drawings, in which.

DETAILED DESCRIPTION OF THE EXEMPLARY EMBODIMENTS

Figure 1:
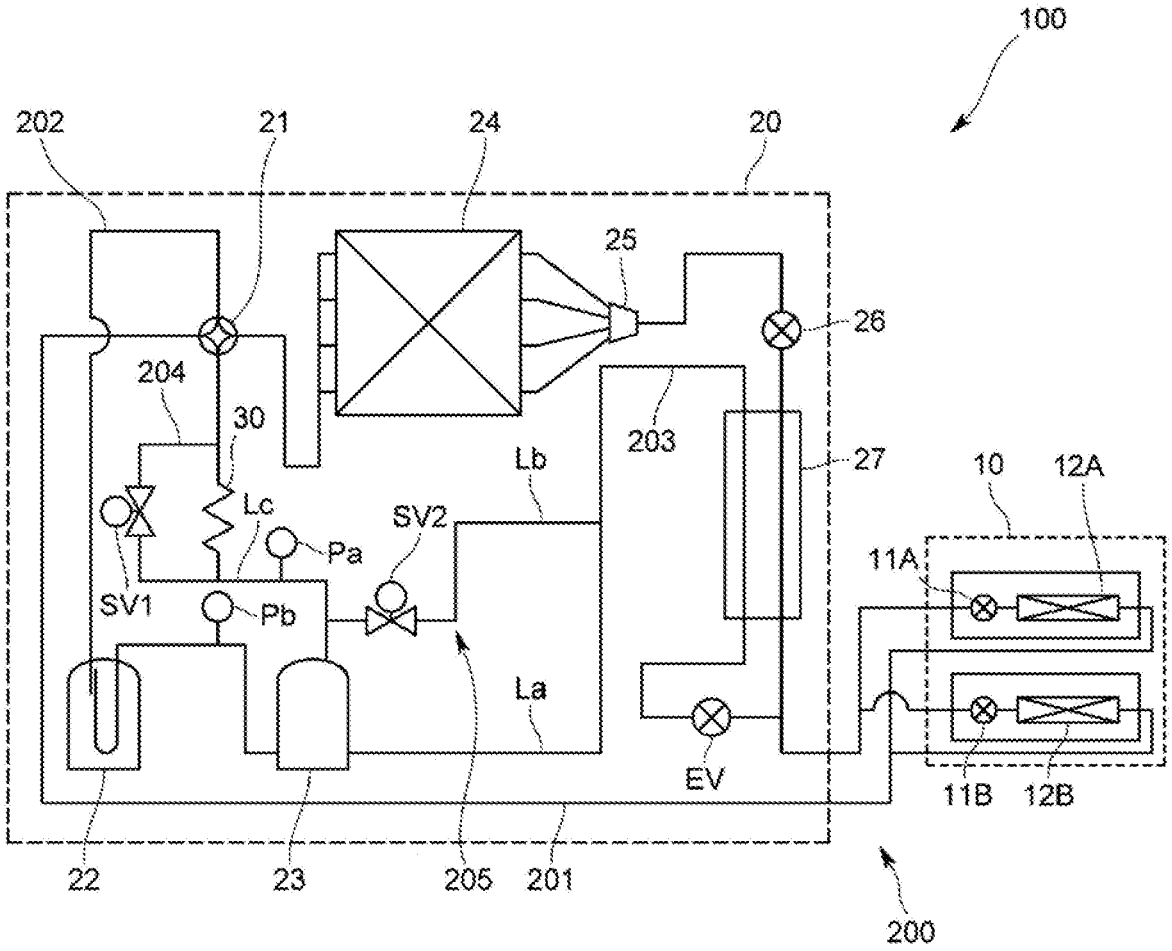
FIG. 1 is a view showing a schematic configuration of an air conditioner according to an exemplary embodiment

Hereinafter, exemplary embodiments will be described in detail with reference to the accompanying drawings. The exemplary embodiments described hereinbelow will be described based on most appropriate embodiments to understand the technical features of the present disclosure, and the technical features of the present disclosure are not limited by the embodiments disclosed herein, and it is illustrated that the present disclosure can be implemented as in the embodiments described below.

Accordingly, various changes can be made within the technical scope of the present disclosure through the embodiments described below, and it should be noted that changes to the embodiments belong to the technical scope of the present invention. In addition, regarding signs described in the accompanying drawings, related components from among the components performing the same operation in the respective embodiments are expressed by the same or similar reference numerals to assist in a comprehensive understanding of the embodiments.

FIG. 1 is a view showing a schematic configuration of an air conditioner 100 according to an exemplary embodiment.

As shown in FIG. 1, the air conditioner 100 according to an exemplary embodiment may include an indoor unit 10, an outdoor unit 20, and a heat pump cycle 200 which is configured to allow refrigerant to flow in the indoor unit 10 and the outdoor unit 20.

The refrigerant used in the air conditioner 100 may be R32 refrigerant or mixed refrigerant including the R2 refrigerant. Through this, the discharge temperature of the refrigerant discharged from a compressor 23 can be increased, and accordingly, the effect of the air conditioner 100 can be enhanced.

The indoor unit 10 may include de-compressors 11A and 11B which are connected (coupled) with each other in parallel, and indoor heat exchangers 12A and 12B which are connected to the de-compressors 11A and 11B, respectively, in series.

The outdoor unit 20 may include a four-way valve 21, an accumulator 22, a compressor 23, an outdoor heat exchanger 24, a divider 25, an expansion valve 26, and an outdoor auxiliary heat exchanger 27.

The heat pump cycle 200 may include a main circuit 201 in which the de-compressors 11A and 11B, the indoor heat exchangers 12A and 12B, the four-way valve 21, the outdoor heat exchanger 24, the divider 25, the expansion valve 26, and the outdoor auxiliary heat exchanger 27 are connected with one another in sequence, and a compression circuit 202 in which the accumulator 22, the compressor 23, and the four-way valve 21 are connected with one another in sequence.

The configurations of the heat pump cycle 200, the main circuit 201, and the compression circuit 202 described above may be changed in various ways, for example, by connecting the above-described components in plural number, omitting some of the above-described components, or replacing some components with other components.

The heat pump cycle 200 may further include an injection channel 203 which makes some of the refrigerant flowing from the de-compressors 11A and 11B to the expansion valve 26 diverge from the above-described main circuit 201, thereby guiding some of or at least a portion of the refrigerant to the compressor 23 rather than guiding, (without guiding), the at least portion of the refrigerant to the outdoor heat exchanger 24.

Specifically, the injection channel 203 may diverge between the expansion valve 26 and the indoor heat exchangers 12A and 12B and may be connected with an inlet of the compressor 23 to allow the refrigerant to flow into the compressor 23.

In addition, an injection valve (EV) may be provided to open and close the injection channel 203, and, in response to the injection valve (EV) being opened, some of or at least a portion of the refrigerant flowing between the expansion valve 26 and the indoor heat exchangers 12A and 12B may flow into the inlet of the compressor 23 through the injection channel 203.

The refrigerant flowing into the inlet of the compressor 23 through the injection channel 203 may have temperature reduced by passing through the outdoor auxiliary heat exchanger 27, and accordingly, the temperature of the refrigerant flowing into the compressor 23 through the injection channel 203 may be lower than the temperature of the refrigerant discharged from an outlet of the compressor 23.

The injection channel 203 may include an injection pipe (La) having one end connected to the inlet of the compressor 23 and the other end connected between the expansion valve 26 and the de-compressors 11A and 11B, the injection valve (EV) provided on the injection pipe (La), and the outdoor auxiliary heat exchanger 27 provided between the compressor 23 and the injection valve (EV) on the injection pipe (La).

In addition, the injection valve (EV) may be an electric motor operated valve which is a flow control valve.

In addition, the outdoor auxiliary heat exchanger 27 may be disposed over the main circuit 201 and the injection channel 203.

As shown in FIG. 1, the compression circuit 202 may include a resistance channel 30 connected to the outlet of the compressor 23.

The resistance channel 30 may be disposed between the outlet of the compressor 23 and the outdoor heat exchanger 24 to increase pressure of the refrigerant discharged from the outlet of the compressor 23.

In addition, the resistance channel 30 may be disposed between the outlet of the compressor 23 and the four-way valve 21.

Specifically, the resistance channel 30 may include a small bore tube or a capillary tube connected to an outlet pipe (Lc) of the compressor 23, and the diameter of the small bore tube or the capillary tube may be smaller than the diameter of the outlet or the outlet pipe (Lc) of the compressor 23. Through this, the refrigerant discharged from the outlet of the compressor 23 may have pressure increased by the resistance channel 30, and thus, differential pressure of the compressor 23 can be ensured.

The compression circuit 202 may include a bypass channel 204 which diverges from the upstream (or compressor outlet) side of the resistance channel 30 on the outlet pipe (Lc) and simultaneously joins the downstream (towards the outdoor heat exchanger) side of the resistance channel 30 on the outlet pipe (Lc).

Accordingly, the bypass channel 204 may be connected with the resistance channel 30 in parallel.

For example, the bypass channel 204 may diverge between the resistance channel 30 and the outlet of the compressor 23 and simultaneously may be connected between the resistance channel 30 and the outdoor heat exchanger 24.

In addition, a bypass valve (SV1) may be provided to open and close the bypass channel 204, and the bypass valve (SV1) may include an electric valve or the like, for example.

In addition, the diameter of the bypass channel 204 may be larger than the diameter of the resistance channel 30, and through this, in response to the bypass valve (SV1) being opened, the flux of the refrigerant passing through the bypass channel 204 may be greater than the flux of the refrigerant passing through the resistance channel 30. In addition, in response to the bypass valve (SV1) being opened, the refrigerant may not pass through the resistance channel 30.

The air conditioner 100 may further include a return channel 205 which has one end connected to the upstream (or compressor outlet) side of the resistance channel 30 on the outlet pipe (Lc), and simultaneously the other end connected to the inlet of the compressor 23, thereby returning some of or at least a portion of the refrigerant discharged from the compressor 23 to the compressor 23.

The return channel 205 may diverge between the outlet of the compressor 23 and the resistance channel 30 and may be connected to the inlet of the compressor 23.

In addition, a return valve (SV2) may be provided to open and close the return channel 205, and for example, the return valve (SV2) may be an electric valve.

In addition, the diameter of the return channel 205 may be larger than the diameter of the resistance channel 30, and through this, in response to the return valve (SV2) being opened, some of the refrigerant discharged from the outlet of the compressor 23 may be returned to the inlet of the compressor 23 through the return channel 205.

Specifically, the return channel 205 may include a connection pipe (Lb) which connects the above-described injection pipe (La) and the outlet pipe (Lc), and the return channel 205 to the inlet of the compressor 23 is formed by a part of the injection pipe (La).

In addition, the injection channel 203 may be configured to have one end diverge between the expansion valve 26 and the indoor heat exchangers 12A and 12B, and to have the other end, which is opposite to one end, diverge from the return channel 205.

The bypass valve (SV1), the return valve (SV2), and the injection valve (EV) described above may be controlled by a controller (not shown). In operating the compressor 23 to perform a cooling operation at low outdoor temperature, the injection valve (EV) provided in the injection pipe (La) and the bypass valve (SV1) provided in the bypass channel 204 are controlled to be closed, and the return valve (SV2) provided in the connection pipe (Lb) is controlled to be opened.

Figure 2:
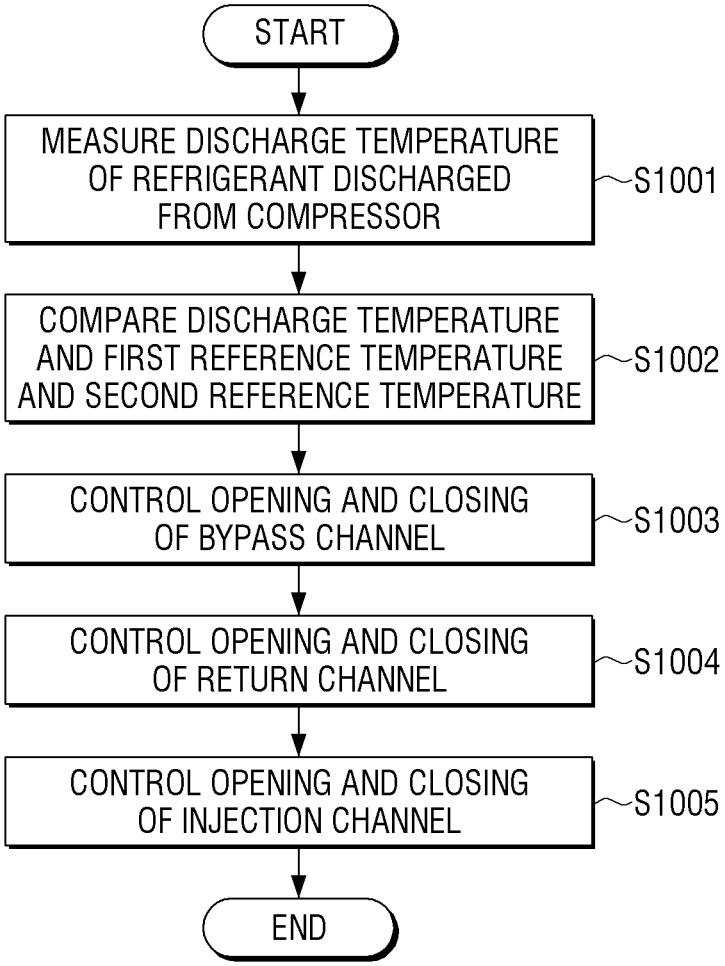
FIGS. 2 and 3 are views showing a control flow according to temperature protection control of the air conditioner shown in FIG. 1.
Figure 3:
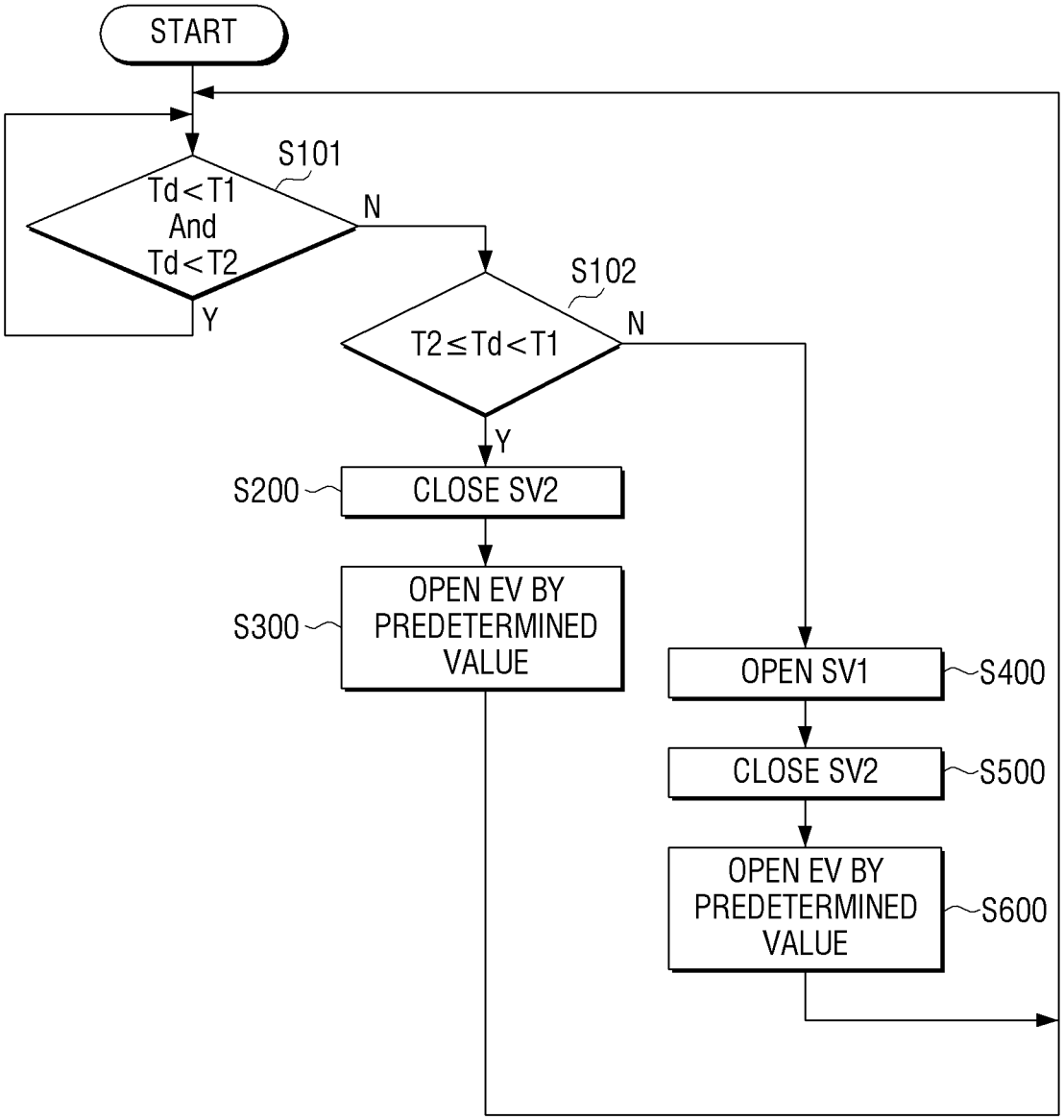
Figure 4:
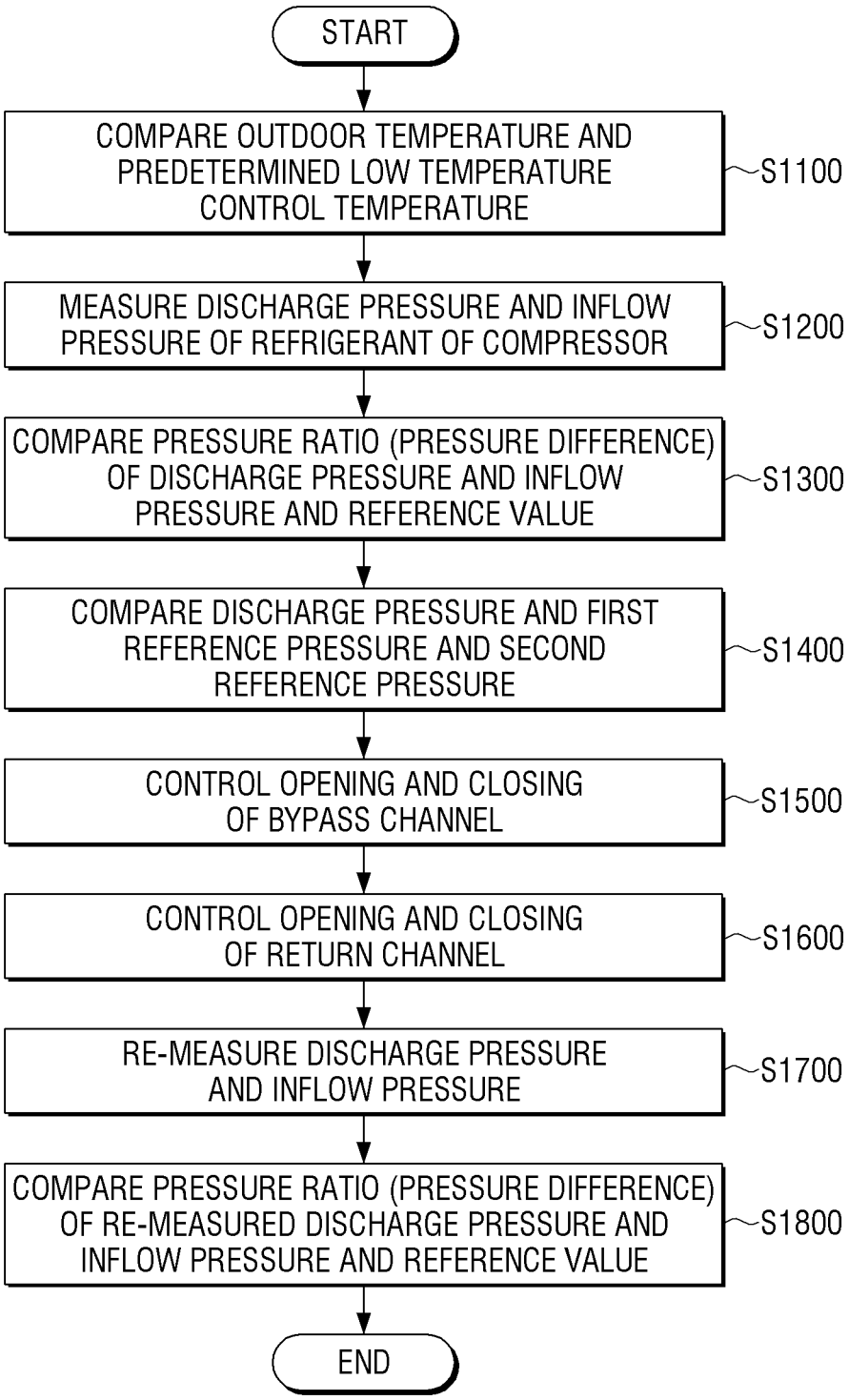
FIGS. 4 and 5 are views showing a control flow according to low-temperature outdoor air control of the air conditioner shown in FIG. 1.
Figure 5:
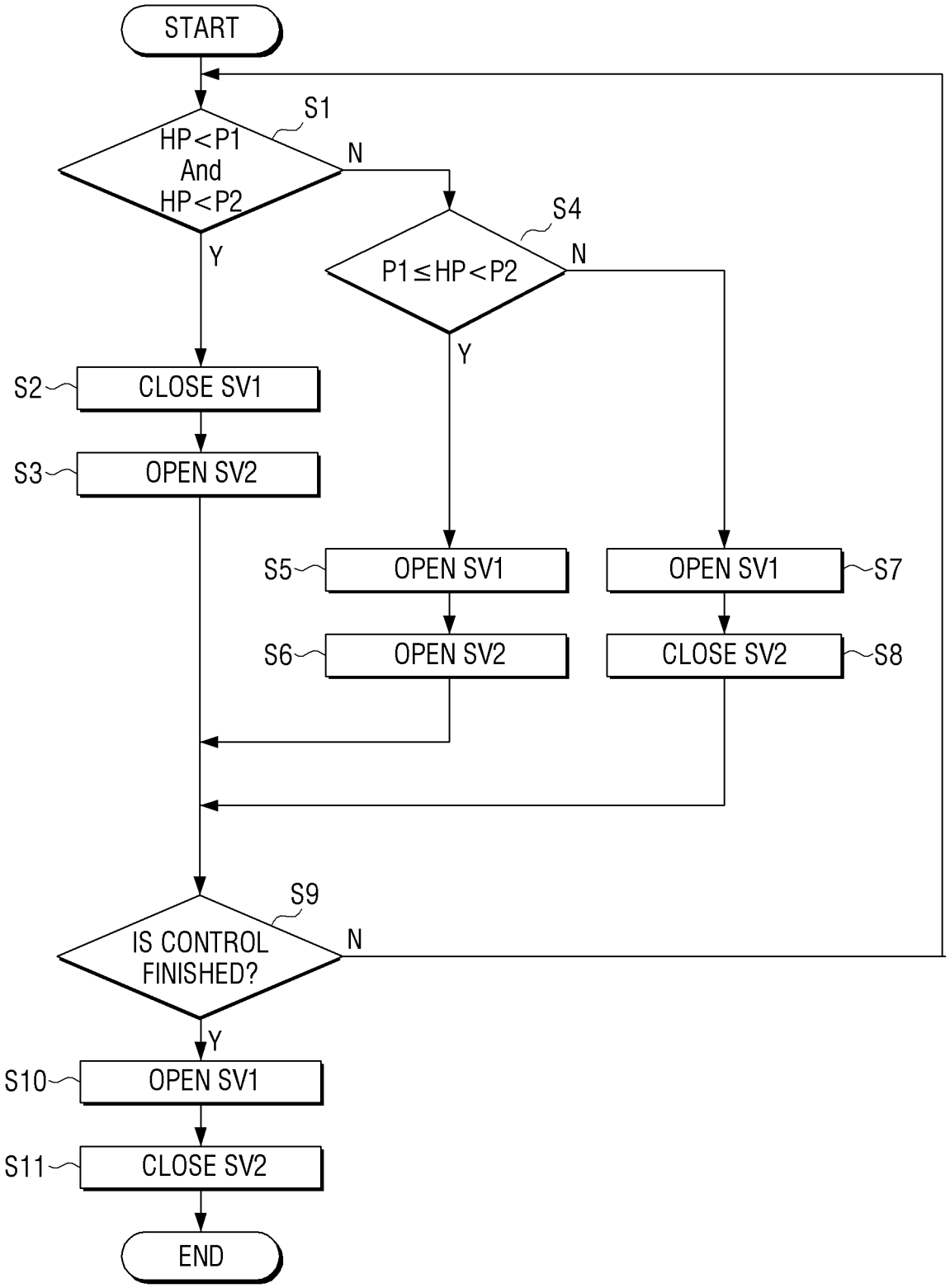

FIGS. 2 and 3 are views illustrating a control flow according to temperature protection control of the air conditioner 100, and FIGS. 4 and 5 are views illustrating a control flow according to low-temperature outdoor air control of the air conditioner 100.

Hereinafter, a control method of the air conditioner 100, which can prevent a breakdown of the compressor 23 or the like by adjusting a sudden rise in refrigerant temperature according to an exemplary embodiment will be described with reference to FIGS. 2 and 3. Hereinafter, the control method of the air conditioner 100 for adjusting the sudden rise in the refrigerant temperature will be referred to as temperature protection control for the convenience of explanation.

In FIG. 2, at S1001, the discharge temperature of refrigerant discharged from the compressor 23 is measured. At S1002, the discharge temperature and first reference temperature and second reference temperature are compared. In response to the comparing, at S1003, S1004 and S1005, the opening and closing of the bypass channel SV1, return channel SV2, and injection channel are controlled for the temperature protection control of the air conditioner. The comparing and control operations, and storing in at least one memory of reference values, may be performed, implemented by at least one controller (for example, machine, electronic circuitry, hardware processor). In response to the compressor 23 being operated, discharge temperature (Td) of refrigerant measured by a temperature sensor (not shown) provided at the outlet of the compressor 23 is compared with predetermined first reference temperature (T1) and predetermined second reference temperature (T2), and it is determined whether the discharge temperature (Td) is smaller than the first reference temperature (T1) and the second reference temperature (T2) (S101).

In addition, for example, the first reference temperature (T1) and the second reference temperature (T2) may be set to temperature for protecting various parts such as the compressor 23, refrigerant, oil, or the like, and hereinafter, the second reference temperature (T2) is set to be lower than the first reference temperature (T1) by way of an example.

In step S101 of determining whether the discharge temperature (Td) is smaller than the first reference temperature (T1) and the second reference temperature (T2), in response to the discharge temperature (Td) being smaller than the first reference temperature (T1) and the second reference temperature (T2), the above-described operation of comparing the temperature continues.

In step S101 of determining whether the discharge temperature (Td) is smaller than the first reference temperature (T1) and the second reference temperature (T2), in response to the discharge temperature (Td) not being smaller than the first reference temperature (T1) and the second reference temperature (T2), it is determined whether the discharge temperature (Td) is greater than or equal to the second reference temperature (T2) and less than the first reference temperature (T1) (S102).

In response to the discharge temperature (Td) being greater than or equal to the second reference temperature (T2) and less than the first reference temperature (T1), the return valve (SV2) is closed (S200) and the injection valve (EV) is opened by a predetermined opening degree (S300).

Through this, the refrigerant discharged from the outlet of the compressor 23 can be prevented from being returned to the compressor 23 through the return channel 205, and the refrigerant of low temperature flows into the inlet of the compressor 23 through the injection channel 203, so that the temperature of the refrigerant can be reduced.

Thereafter, the control method resumes step S101 to determine whether the discharge temperature (Td) is smaller than the first reference temperature (T1) and the second reference temperature (T2), and continues comparing the temperatures as described above.

In step S102 of determining whether the discharge temperature (Td) is greater than or equal to the second reference temperature (T2) and less than the first reference temperature (T1), in response to the discharge temperature (Td) not being greater than or equal to the second reference temperature (T2) and not being less than the first reference temperature (T1), that is, in response to the discharge temperature (Td) being greater than or equal to the first reference temperature (T1), the bypass valve (SV1) is opened (S400), the return valve (SV2) is closed (S500), and the injection valve (EV) is opened by a predetermined opening degree (S600).

Through this, the refrigerant discharged from the compressor 23 flows through the bypass channel 204, and thus does not pass through the resistance channel 30. Therefore, the pressure of the refrigerant does not rise and a rise in temperature caused by rising pressure can also be prevented. In addition, by closing the return channel 205, the refrigerant discharged from the outlet of the compressor 23 can be prevented from being returned to the compressor 23 through the return channel 205. In addition, the refrigerant of low temperature flows into the inlet of the compressor 23 through the injection channel 203, so that the temperature of the refrigerant can be reduced.

Thereafter, the control method resumes step S101 to determine whether the discharge temperature (Td) is smaller than the first reference temperature (T1) and the second reference temperature (T2), and continues comparing the temperatures as described above.

Through the above-described temperature protection control, temperature can be maintained even when the compressor 23 is operated and the temperature of the refrigerant increases by high temperature, so that a breakdown of various devices such as the compressor 23, refrigerant, oil, or the like can be prevented by high temperature, and various problems of the air conditioner 100 caused by a sudden rise in the refrigerant temperature can be prevented in advance.

In addition, the above-described temperature protection control may be performed before low-temperature outdoor air control, which will be described below, is performed, or at the same time.

Hereinafter, a control method of the air conditioner 100 according to a cooling operation at low outdoor temperature will be described with reference to FIGS. 4 and 5. Hereinafter, the control method of the air conditioner 100 according to the cooling operation at the low outdoor temperature will be referred to as low-temperature outdoor air control for the convenience of explanation.

The low-temperature outdoor air control may be performed in response to outdoor temperature measured through a temperature measurement sensor (not shown) provided in the outdoor unit 20 being lower than predetermined low-temperature control temperature, and in response to a pressure ratio between discharge pressure (HP) of the refrigerant discharged through the outlet of the compressor 23 and inflow pressure (LP) of the refrigerant flowing through the inlet of the compressor 23, or a pressure difference between the discharge pressure (HP) and the inflow pressure (LP) being smaller than a predetermined reference value.

Accordingly, in response to the outdoor temperature being greater than or equal to the low-temperature control temperature, or the pressure ratio or pressure difference between the discharge pressure (HP) and the inflow pressure (LP) being greater than or equal to the reference value, separate low-temperature outdoor air control is not performed, and the bypass channel 204 is opened by opening the bypass valve (SV1), and the return channel 205 is closed by closing the return valve (SV2). Through this, the air conditioner may have the refrigerant discharged through the outlet of the compressor 23 flow without any change in the pressure by simply being operated in a normal way.

In addition, the discharge pressure (HP) may be measured by a discharge pressure sensor (Pa) provided at the outlet of the compressor 23, and the inflow pressure (LP) may be measured by an inflow pressure sensor (Pb) provided at the inlet of the compressor 23.

The low-temperature outdoor air control may be set to be performed in response to the outdoor temperature being less than or equal to approximately 10 degrees Celsius and the discharge pressure (HP)/inflow pressure (LP) is approximately less than 2.1.

In response to the low-temperature outdoor air control being performed and the compressor 23 being operated, it is determined whether the discharge pressure (HP) is smaller than first reference pressure (P1) and second reference pressure (P2) by comparing the discharge pressure (HP) and the predetermined first reference pressure (P1) and the predetermined second reference pressure (P2) (S1).

The first reference pressure (P1) and the second reference pressure (P2) are values which are pre-set based on design pressure of the compressor 23, for example, and, hereinafter, the second pressure (P2) is set to be greater than the first reference pressure P1 by way of an example.

In step S1 of determining whether the discharge pressure (HP) is smaller than the first reference pressure (P1) and the second reference pressure (P2), in response to the discharge pressure (HP) being smaller than the first reference pressure (P1) and the second reference pressure (P2), the bypass filter (SV1) is maintained as being in the closing state (S2), and also, the return valve (SV2) is maintained as being in the open state (S3).

Through this, the refrigerant discharged through the outlet of the compressor 23 may have its pressure increased by passing through the resistance channel 30, and differential pressure can be ensured. In addition, some of the refrigerant is returned to the compressor 23 through the return channel 205, so that the pressure of the refrigerant can be prevented from suddenly rising.

In addition, by increasing the pressure of the compressor 23, a supercooling phenomenon occurs by high condensation ability and evaporation temperature is reduced, so that cooling efficiency can be prevented from deteriorating.

In step S1 of determining whether the discharge pressure (HP) is smaller than the first reference pressure (P1) and the second reference pressure (P2), in response to the discharge pressure (HP) not being smaller than the first reference pressure (P1) and the second reference pressure (P2), it is determined whether the discharge pressure (HP) is greater than or equal to the first reference pressure (P1) and less than the second reference pressure (P2) (S4).

In step S4 of determining whether the discharge pressure (HP) is greater than or equal to the first reference pressure (P1) and less than the second reference pressure (P2), in response to the discharge pressure (HP) being greater than or equal to the first reference pressure (P1) and being less than the second reference pressure (P2), the bypass valve (SV1) is opened (S5) and the return valve (SV2) is opened (S6).

Through this, in the refrigerant discharged through the outlet of the compressor 23, the flux of the refrigerant passing through the bypass channel 204 is larger than the flux of the refrigerant passing through the resistance channel 30, and thus the pressure of the refrigerant does not rise, and some of the refrigerant is returned to the compressor 23 through the return channel 205, so that the pressure of the refrigerant can be prevented from being suddenly changed.

In addition, the pressure of the compressor 23 may be increased only by the refrigerator returned through the return channel 205, and through this, a compression ratio for maintaining reliability of the compressor 23 selectively according to an environmental condition and condensation temperature can be ensured.

In step S4 of determining whether the discharge pressure (HP) is greater than or equal to the first reference pressure (P1) and less than the second reference pressure (P2), in response to the discharge pressure (HP) not being greater than or equal to the first reference pressure (P1) and not being less than the second reference pressure (P2), that is, in response to the discharge pressure (HP) being greater than or equal to the second reference pressure (P2), the bypass valve (SV1) is opened (S7) and the return valve (SV2) is closed (S8).

This is the case in which the differential pressure of the compressor 23 is already ensured, and the refrigerant discharged from the outlet of the compressor 23 may flow into the bypass channel 204 without any change in the pressure through a normal operation of the air conditioner 100.

Thereafter, it is determined whether the low-temperature outdoor air control is finished or not by a controller (S9).

Specifically, the low-temperature outdoor air control may be set to be finished in response to a pressure ratio or a pressure difference between re-measured discharge pressure (HP) and re-measured inflow pressure (LP) being greater than the predetermined reference value.

For example, the low-temperature outdoor air control may be set to be finished in response to the discharge pressure (HP)/inflow pressure (LP) being greater than or equal to approximately 2.1 and the discharge pressure (HP) being greater than 15 kgf/cm2 G.

In step S9 of determining whether to finish the low-temperature outdoor air control or not, in response to the low-temperature outdoor air control being finished, the bypass valve (SV1) is opened or maintained opened (as the case may be) (S10) and simultaneously the return valve (SV2) is closed or maintained closed (as the case may be) (S11). Through this, the refrigerator discharged from the outlet of the compressor 23 flows into the bypass channel 204 without any change in the pressure.

In step S9 of determining whether to finish the low-temperature outdoor air control or not, in response to the low-temperature outdoor air control not being finished, the control method resumes step S1 to determine whether the discharge pressure (HP) is smaller than the first reference pressure (P1) and the second reference pressure (P2), and compares the discharge pressure (HP) and the first reference pressure (P1) and the second reference pressure (P2).

Since the air conditioner 100 according to an exemplary embodiment includes the resistance channel 30 at the outlet of the compressor 23, differential pressure of the compressor 23 can be easily ensured in a cooling operation at low outdoor temperature, and also, by returning some of the refrigerator to the compressor 23 through the return channel 205 when the compressor 23 is operated, the pressure of the refrigerator can be prevented from suddenly rising.

Figure 6:
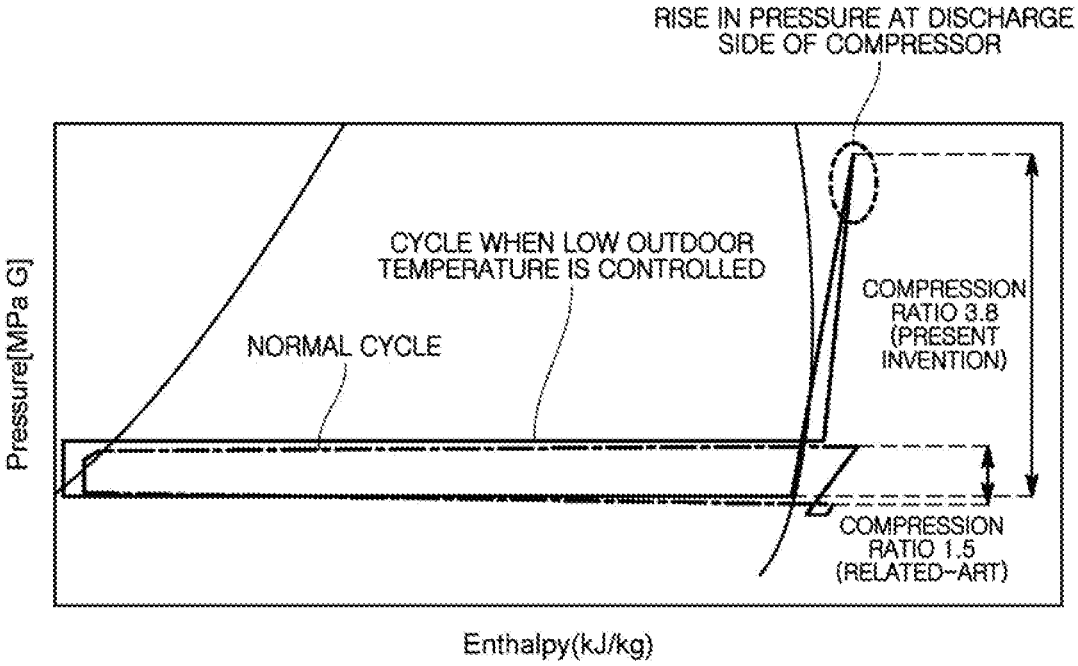
FIG. 6 is view showing experimental data indicating an effect accompanied by low-temperature outdoor air control shown in FIGS. 4 and 5.

Experimental data indicating an effect accompanied by the above-described low-temperature outdoor air control is illustrated in FIG. 6.

As known through the experimental data of FIG. 6, the compression ratio of a related-art compressor was 1.5, whereas the discharge pressure of the outlet of the compressor 23 rapidly increased by performing the low-temperature outdoor air control of the air conditioner according to an exemplary embodiment, and the compression ratio was also enhanced up to 3.8.

As described above, a rotary forming (rotation of) the compressor 23 can be ensured by increasing the discharge pressure of the outlet of the compressor 23, and through this, rattling of the compressor 23 can be reduced.

In addition, the return channel 205 is configured by connecting the injection pipe (La) and the outlet pipe (Lc), so that a part of the injection channel 203 can be utilized as the return channel 205. Therefore, the entire configuration of the air conditioner 10 can be simplified and also the differential pressure of the compressor 23 can be ensured in the cooling operation at the low outdoor temperature.

In addition, through the bypass valve (SV1) selectively opening and closing the bypass channel 204 bypassing the resistance channel 30, the refrigerator discharged from the compressor 23 can be prevented from flowing into the resistance channel 30 when it is not necessary to increase the discharge pressure of the compressor 23.

The control method of the air conditioner 100 according to exemplary embodiments is not limited to the above-described embodiments.

In the above-described embodiments, the air conditioner 100 is applied to the cooling operation at the low outdoor temperature. However, the air conditioner 100 according to an exemplary embodiment may be operated in other conditions in addition to the low outdoor temperature.

In addition, in response to the air conditioner 100 being operated in a heating operation mode or a defrosting mode, some of the refrigerator discharged from the compressor 23 is made to be returned to the compressor 23 and the remaining refrigerator is made to flow into the indoor heat exchangers 12A and 12B or the outdoor heat exchangers 24. Therefore, rapid heating performance can be enhanced or time required to defrost can be reduced by increasing the temperature of the refrigerant.

In addition, the above-described indoor unit 10 includes two indoor heat exchangers connected to each other in parallel. However, the indoor unit 10 may include three or more indoor heat exchangers.

In addition, the above-described air conditioner 100 includes the single compressor 23. However, the air conditioner 100 may include a plurality of compressors.

Figure 7:
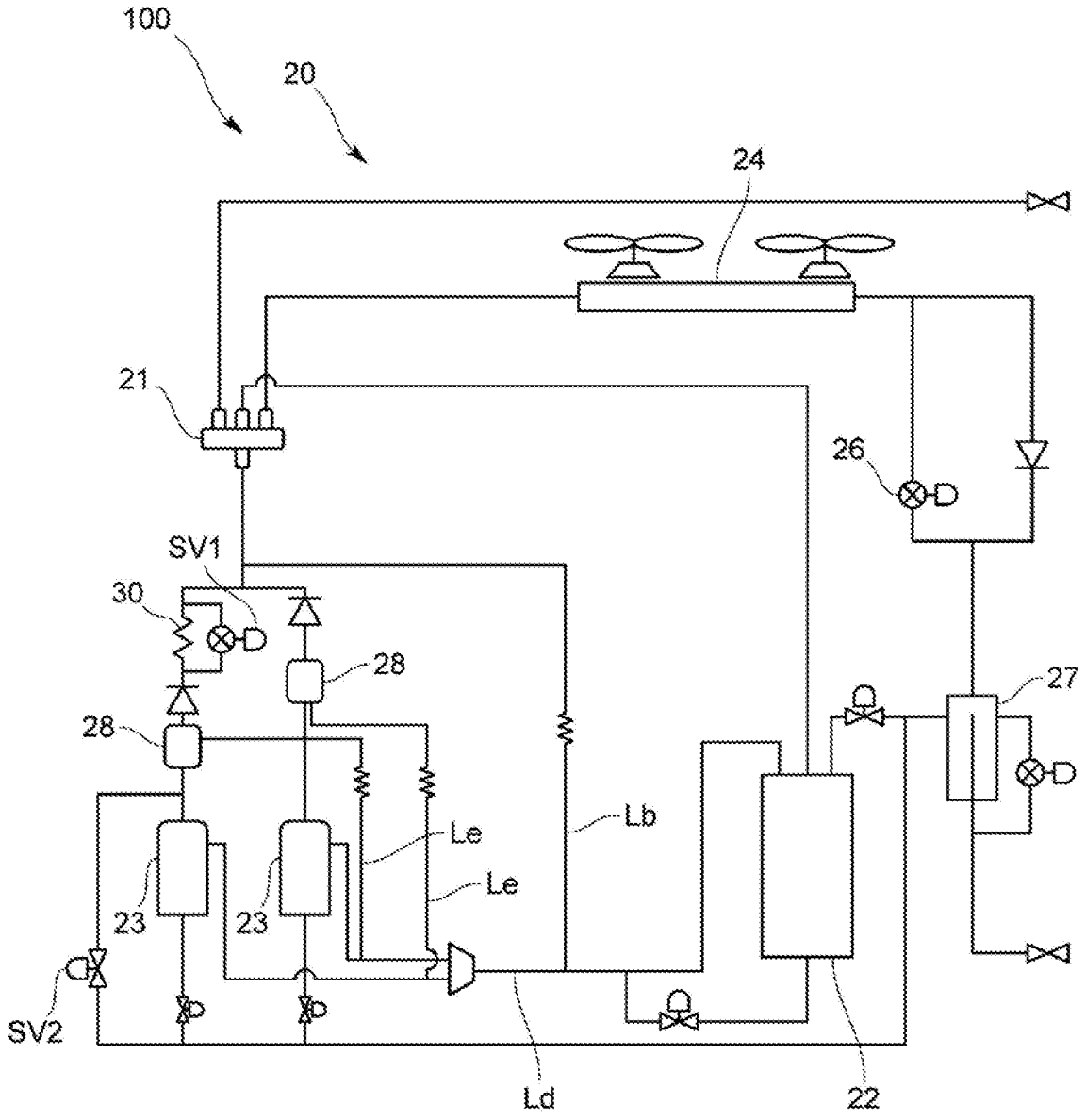
FIG. 7 is a view showing a schematic configuration of an air conditioner according to another exemplary embodiment.
Figure 8:
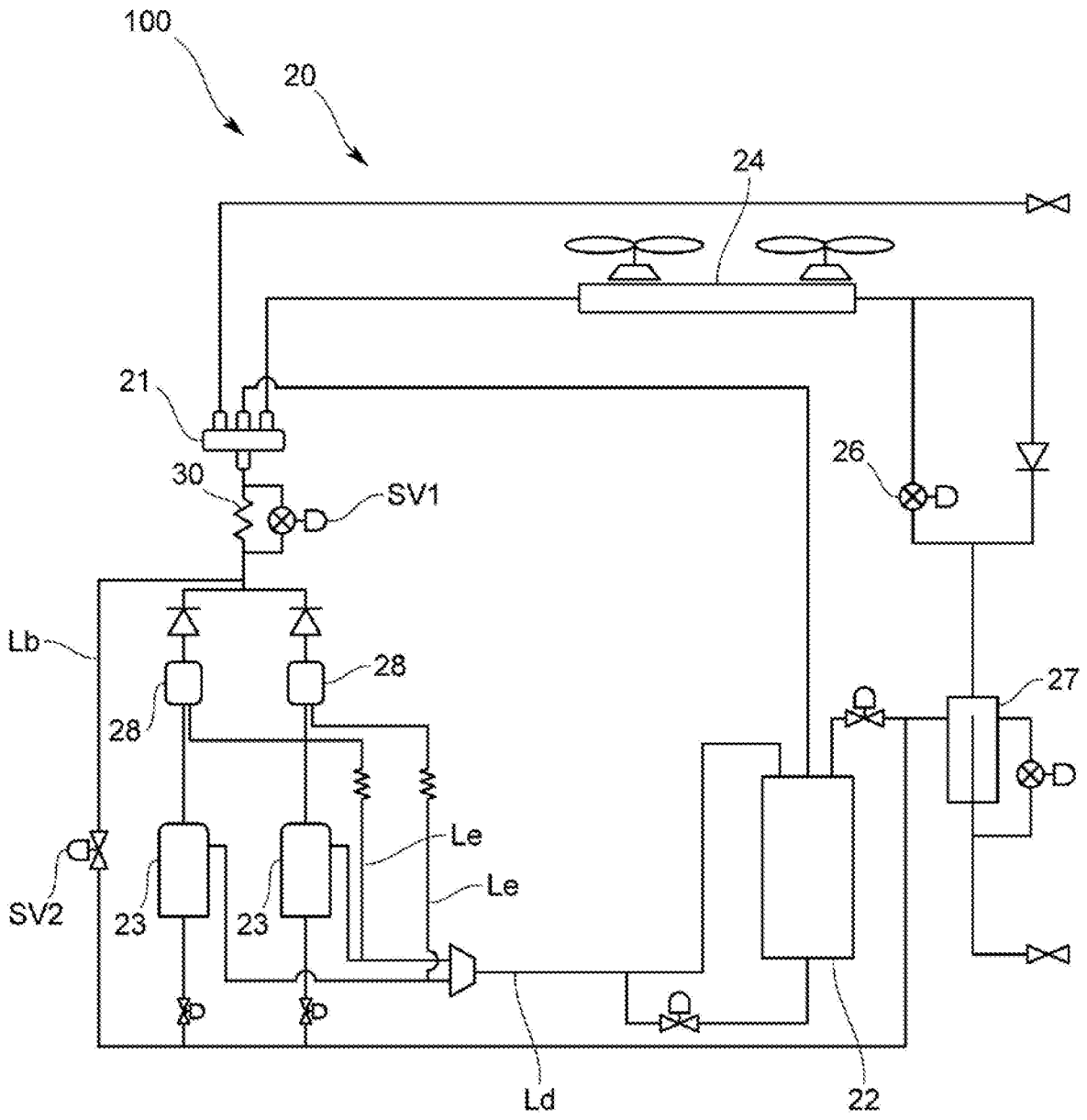
FIG. 8 is a view showing a schematic configuration of an air conditioner according to another exemplary embodiment.

FIG. 7 is a view showing a schematic configuration of an air conditioner according to another exemplary embodiment, and FIG. 8 is a view showing a schematic configuration of an air conditioner according to another exemplary embodiment.

FIGS. 7 and 8 show a refrigerant circuit of an outdoor unit 20 having two compressors 23. In addition, the compressors 23 may have the same capacity or may have different capacity.

In a cooling operation of the air conditioner shown in FIGS. 7 and 8 at low outdoor temperature, any one of the compressors 23 is controlled to be operated and a resistance channel 30 may be provided in an outlet pipe (Lc) of the compressor 23 which is used in the cooling operation at the low outdoor temperature.

In addition, the air conditioner may include a bypass channel connected to the resistance channel 30 in parallel, and a bypass valve (SV1), and may close the bypass valve (SV1) in response to low-temperature outdoor air control being performed.

The air conditioner 100 shown in FIGS. 7 and 8 may include an accumulator 22 which introduces refrigerant passing through an evaporator, a suction pipe (Ld) to draw gas refrigerant divided by the accumulator 22 in each compressor 23, an oil divider provided at an outlet of each of the compressors 23, and an oil deriving pipe (Le) which introduces oil separated by the oil divider 28 and also derives the oil in the other compressor 23 which is different from the compressor 23 corresponding to the oil divider 28.

Through this configuration, the oil separated by each oil divider 28 is supplied to the compressor 23 which is different from the compressor 23 corresponding to each oil divider 28, so that an oil imbalance phenomenon in which oil is concentrated on a specific compressor 23 can be prevented even when the plurality of compressors 23 of different capacity are operated.

Figure 9:
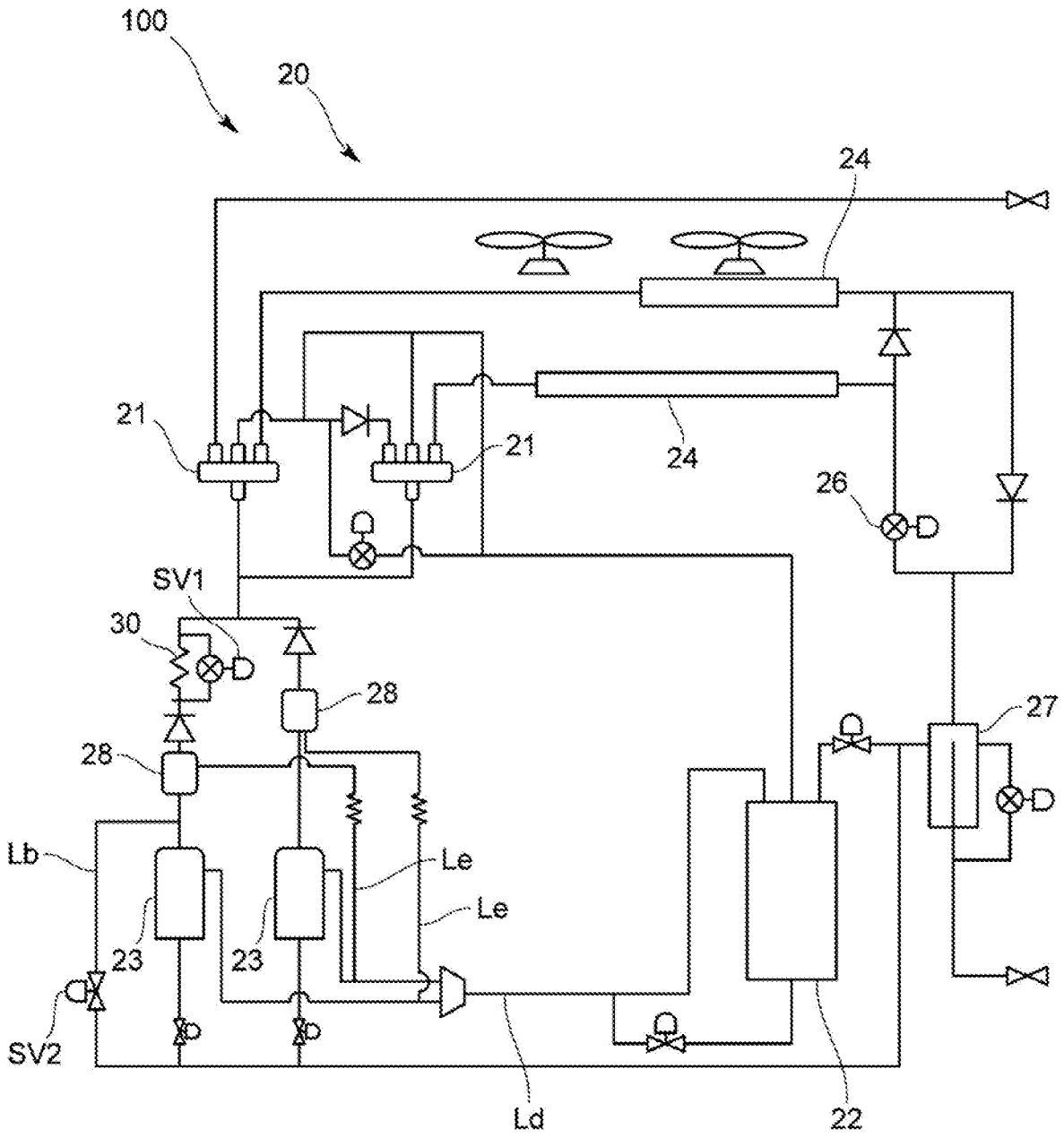
FIG. 9 is a view showing a schematic configuration of an air conditioner according to another exemplary embodiment.
Figure 10:
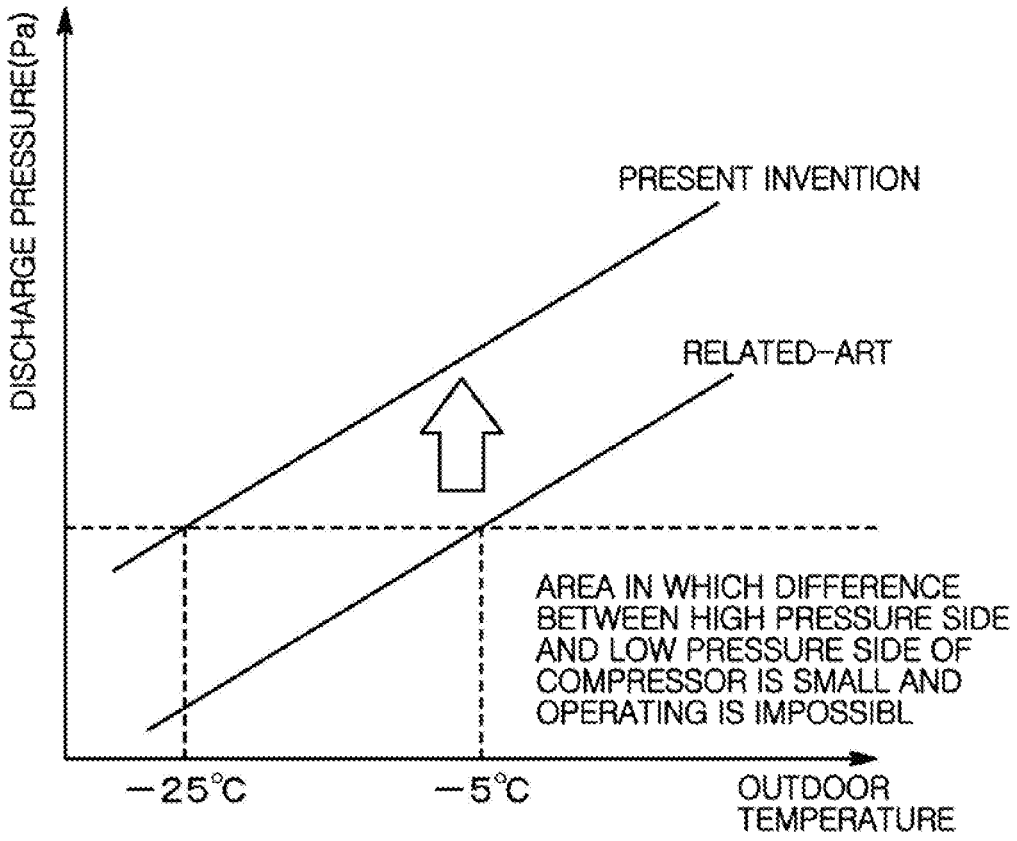
FIG. 10 is a graph showing an effect of the air conditioner shown in FIG. 9.

FIG. 9 is a view showing a schematic configuration of an air conditioner according to another exemplary embodiment, and FIG. 10 is a graph showing an effect of the air conditioner shown in FIG. 9.

In the above-described embodiments, the air conditioner having a single outdoor heat exchanger has been described. However, the air conditioner 100 shown in FIG. 9 may include a plurality of outdoor heat exchangers 24 provided in parallel.

In addition, the air conditioner 100 may include two outdoor heat exchangers 24 having different heat exchange efficiency.

Through the above-described configuration, a capacity switch function of the outdoor heat exchangers 24 can be used. By selecting the outdoor heat exchanger 24 having low heat exchange efficiency, that is, the outdoor heat exchanger 24 having small capacity, the discharge pressure of the compressor 23 can be further increased, and temperature operation range of the air conditioner 100 can be extended as shown in FIG. 10.

In addition, by increasing the discharge pressure of the compressor 23 as described above, it is possible to perform the cooling operation and the heating operation normally even when there is a difference in the outdoor heat exchanger 24 and the indoor heat exchanger 12.

In the above-described description, various embodiments have been individually described, but the embodiments should not be necessarily implemented independently and the configuration and operation of the embodiments may be implemented in combination with at least one other embodiment.

While the invention has been shown and described with reference to certain preferred embodiments thereof, it will be understood by those skilled in the art that various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

What is claimed is:

1. An air conditioner comprising:

a multi-way valve having an input and a plurality of outputs;

an outdoor heat exchanger coupled to an output of the plurality of outputs of the multi-way valve;

a first compressor;

a resistance channel disposed between an outlet of the first compressor and the input of the multi-way valve and configured to increase pressure of a refrigerant flowing from the outlet of the first compressor to the outdoor heat exchanger via the multi-way valve;

a bypass channel coupled to the resistance channel in parallel;

a bypass valve configured to open and close the bypass channel and so that, based on the bypass valve being opened, the refrigerant flowing from the outlet of the first compressor to the outdoor heat exchanger via the multi-way valve does not pass through the resistance channel;

a second compressor having an outlet through which a refrigerant flows to the input of the multi-way valve and then to the outdoor heat exchanger via the multi-way valve, without the resistance channel being between the outlet of the second compressor and the input of the multi-way valve;

a return channel having one end disposed downstream of the resistance channel and the bypass channel, downstream of the outlet of the second compressor, and upstream of the input of the multi-way valve, and another end that is branched into a first branch coupled with an inlet of the first compressor and a second branch coupled to an inlet of the second compressor;

a first oil divider at an output of the first compressor and upstream of the resistance channel and the bypass channel;

a second oil divider at an output of the second compressor and upstream of the input of the multi-way valve;

a first pipe to provide oil separated by the first oil divider to the second compressor; and a second pipe to provide oil separated by the second oil divider to the first compressor, wherein the first compressor is controlled to be operated using the resistance channel in a cooling operation at a lower outdoor temperature than the second compressor is operated at.

2. The air conditioner of claim 1, wherein the resistance channel comprises a small bore tube or a capillary tube which has a diameter smaller than a diameter of the outlet of the first compressor.

3. The air conditioner of claim 1, wherein a diameter of the return channel is larger than a diameter of the resistance channel.

4. The air conditioner of claim 1, wherein a diameter of the bypass channel is larger than a diameter of the resistance channel, the bypass channel thereby being configured so that, based on the bypass valve being opened, a flux of refrigerant passing through the bypass channel is larger than a flux of refrigerant passing through the resistance channel.

5. The air conditioner of claim 1, wherein the refrigerant is R32 refrigerant or mixed refrigerant comprising R32 refrigerant.

6. The air conditioner of claim 1, wherein the bypass valve is configured to be controlled to maintain a discharge temperature of the refrigerant from the first compressor within a temperature range.

7. The air conditioner of claim 1, further comprising:

at least one processor configured to control the bypass valve in accordance with a discharge temperature of the refrigerant from the first compressor.

8. The air conditioner of claim 1, further comprising:

at least one processor configured to control the bypass valve to maintain a discharge temperature of the refrigerant from the first compressor within a temperature range.

* * * * *